US006616490B2

(12) United States Patent
Wada et al.

(10) Patent No.: US 6,616,490 B2
(45) Date of Patent: Sep. 9, 2003

(54) OUTBOARD MOTOR AUXILIARY FUEL TANK/FUEL PUMP ASSEMBLY

(75) Inventors: Tetsu Wada, Wako (JP); Tomonori Ikuma, Wako (JP); Sadafumi Shidara, Wako (JP); Jun Kimura, Kawasaki (JP); Fumihiko Sugiura, Kawasaki (JP)

(73) Assignees: Honda Giken Kogyo Kabushiki Kaisha, Tokyo (JP); Keiflin Corporation, Tokyo (JP)

( * ) Notice: Subject to any disclaimer, the term of this patent is extended or adjusted under 35 U.S.C. 154(b) by 0 days.

(21) Appl. No.: 10/195,549

(22) Filed: Jul. 16, 2002

(65) Prior Publication Data

US 2003/0045186 A1 Mar. 6, 2003

(30) Foreign Application Priority Data

Jul. 16, 2001 (JP) ..... 2001-215219

(51) Int. Cl.[7] ..... B63H 21/10
(52) U.S. Cl. ..... 440/88 F
(58) Field of Search ..... 440/88, 88 F, 88 R; 123/509

(56) References Cited

U.S. PATENT DOCUMENTS 5,984,743 A * 11/1999 Wada et al. ..... 440/88 R
6,390,871 B1 * 5/2002 Wickman et al. ..... 440/88 R
6,527,603 B1 * 3/2003 Wickman et al. ..... 123/509

FOREIGN PATENT DOCUMENTS

JP 10-184375 7/1998

* cited by examiner

*Primary Examiner*—S. Joseph Morano
*Assistant Examiner*—Andrew Wright
(74) *Attorney, Agent, or Firm*—Arent Fox Kintner Plotkin & Kahn, PLLC

(57) ABSTRACT

An outboard motor auxiliary fuel tank/fuel pump assembly includes an auxiliary fuel tank disposed in an engine compartment and a fuel pump joined to one side of the auxiliary fuel tank for supplying fuel stored within the auxiliary fuel tank to fuel injection valves of an engine. A float of a float valve provided within the auxiliary fuel tank is supported in the auxiliary fuel tank via a pivot shaft that is parallel to a tilt shaft of an outboard motor. First and second mounting bosses on which the fuel pump can be mounted are formed on the right side face and the front end face of the auxiliary fuel tank.

2 Claims, 13 Drawing Sheets

OUTBOARD MOTOR AUXILIARY FUEL TANK/FUEL PUMP ASSEMBLY

BACKGROUND OF THE INVENTION

1. Field of the Invention

The present invention relates to an improvement in an outboard motor auxiliary fuel tank/fuel pump assembly that includes an auxiliary fuel tank that is disposed in a space on either of the front, back, left and right sides of an engine in an engine compartment of an outboard motor and stores fuel that is fed from a fuel tank.

2. Related Art

A conventional outboard motor auxiliary fuel tank/fuel pump assembly is already known and disclosed in, for example, Japanese Patent Application Laid-open No. 10-184375.

When installing such a conventional auxiliary fuel tank/fuel pump assembly in a relatively small engine compartment, a space located either to the front or rear of the engine or the left or right side of the engine is utilized to position the assembly depending on the type of engine. It is well known in the industry that even in a state where the outboard motor is tilted up, for example, when traveling in shallow water, it is necessary for the pivot shaft of the float valve of the auxiliary fuel tank to always be parallel relative to the tilt shaft of the outboard motor in order to secure normal operation of the float valve. Therefore, when the auxiliary fuel tank/fuel pump assembly is installed in any of the above-mentioned front, rear, left, and right spaces, the orientation of the auxiliary fuel tank is determined by the orientation of the pivot shaft of the float valve.

Accordingly, it has been general practice in the industry to establish the spaces to the front and rear of the engine in the engine compartment so as to be narrower in the front-and-rear direction than in the left-and-right direction, and the spaces on the left and right sides of the engine are set so as to be narrower in the left-and-right direction than the front-and-rear direction in order to avoid restricting the maximum steering angle caused by the raised position of the rear end of the outboard motor when it is tilted up or by the positions to which opposite sides of the outboard motor protrude when steering to the left or right. It is therefore necessary for the auxiliary fuel tank and the fuel pump to be connected so as to be aligned in the left-and-right direction when the auxiliary fuel tank/fuel pump assembly is arranged in the space to the front or rear of the engine. Furthermore, it is necessary for the auxiliary fuel tank and the fuel pump to be connected so as to be aligned in the front-and-rear direction when the assembly is arranged in the space on the left or right side of the engine. Because of this difference in the position of the auxiliary fuel tank to which the fuel pump is connected, a different conventional auxiliary fuel tank is used exclusively for each of the above-described cases and is produced so as to correspond to the space where the auxiliary fuel tank/fuel pump assembly is installed. This decreases the effectiveness of mass-producing the auxiliary fuel tank, which results in increasing manufacturing costs.

SUMMARY OF THE INVENTION

It is an object of the present invention to at least overcome the above-described drawbacks of the conventional fuel tank/fuel pump assemblies.

It is also an object of the present invention to provide an outboard motor auxiliary fuel tank/fuel pump assembly that can reasonably be arranged within any of the spaces to the front, rear, left, and right sides of the engine even when the same type of auxiliary fuel tank is used. The structural arrangement of the present invention increases the effectiveness of mass-producing the auxiliary fuel tank, improves space efficiency, and decreases manufacturing costs.

According to a preferred embodiment of the present invention, there is provided an outboard motor auxiliary fuel tank/fuel pump assembly that includes an auxiliary fuel tank disposed in an engine compartment of an outboard motor that stores fuel fed from a fuel tank on a hull side. A fuel pump is joined to one side of the auxiliary fuel tank and supplies the fuel stored within the auxiliary fuel tank to a fuel injection valve of an engine. A float valve having a float is provided within the auxiliary fuel tank and opens/closes a fuel inlet port of the auxiliary fuel tank according to the level of the stored fuel. The float is supported in a vertically swingable manner in the auxiliary fuel tank via a pivot shaft that is parallel to a tilt shaft of the outboard motor. An air vent pipe is connected to the auxiliary fuel tank and communicates with an upper space within the auxiliary fuel tank. The assembly also includes first and second mounting parts on which the fuel pump is mounted. The first and second mounting parts are formed, respectively, on an outer face of the auxiliary fuel tank that is vertical and perpendicular to the tilt shaft and on an outer face of the auxiliary fuel tank that is vertical and parallel to the tilt shaft.

In accordance with the preferred embodiment, the same type of auxiliary fuel tank can be used where the auxiliary fuel tank/fuel pump assembly is arranged in the space to the front or rear of the engine by connecting the auxiliary fuel tank and the fuel pump so as to be aligned in the left-and-right direction, and where the auxiliary fuel tank/fuel pump assembly is arranged in the space on the left or right side of the engine by connecting the auxiliary fuel tank and the fuel pump so as to be aligned in the front-and-rear direction. It is therefore possible to reasonably provide a structural arrangement of the auxiliary fuel tank/fuel pump assembly using the same type of auxiliary fuel tank in all cases, thereby enhancing the space efficiency and mass-production of the auxiliary fuel tank. Moreover, in all cases, since the pivot shaft of the float valve within the auxiliary fuel tank is maintained parallel to the tilt shaft, the float valve can properly be operated when the outboard motor is tilted up.

In accordance with a second embodiment of the present invention, there is an outboard motor auxiliary fuel tank/fuel pump assembly that further includes first and second connecting bosses provided, respectively, on the outer face of the auxiliary fuel tank on which the first mounting part has been formed and on the outer face of the auxiliary fuel tank on which the second mounting part has been formed. A suction pipe of the fuel pump is connected to the first and second connecting bosses. The connecting bosses include a blocking wall through which a hole is made when the suction pipe is connected thereto.

accordance with the second embodiment, when the fuel pump is mounted either on the first or second mounting part of the auxiliary fuel tank, the suction pipe is connected to the corresponding connecting boss at the same time, such that the connection operation is performed rather rapidly.

The first and second mounting parts may correspond to first and second bosses, and the fuel pump may correspond to a secondary fuel pump.

BRIEF DESCRIPTION OF DRAWINGS

The structural arrangement and method for carrying out the present invention are described below by reference to preferred embodiments of the present invention shown in the attached drawings, wherein.

DETAILED DESCRIPTION OF PREFERRED EMBODIMENTS

In the explanation below, the terms 'front', 'rear', 'left', and 'right' are used with reference to a hull H on which an outboard motor $O_1$ is mounted.

Figure 1:
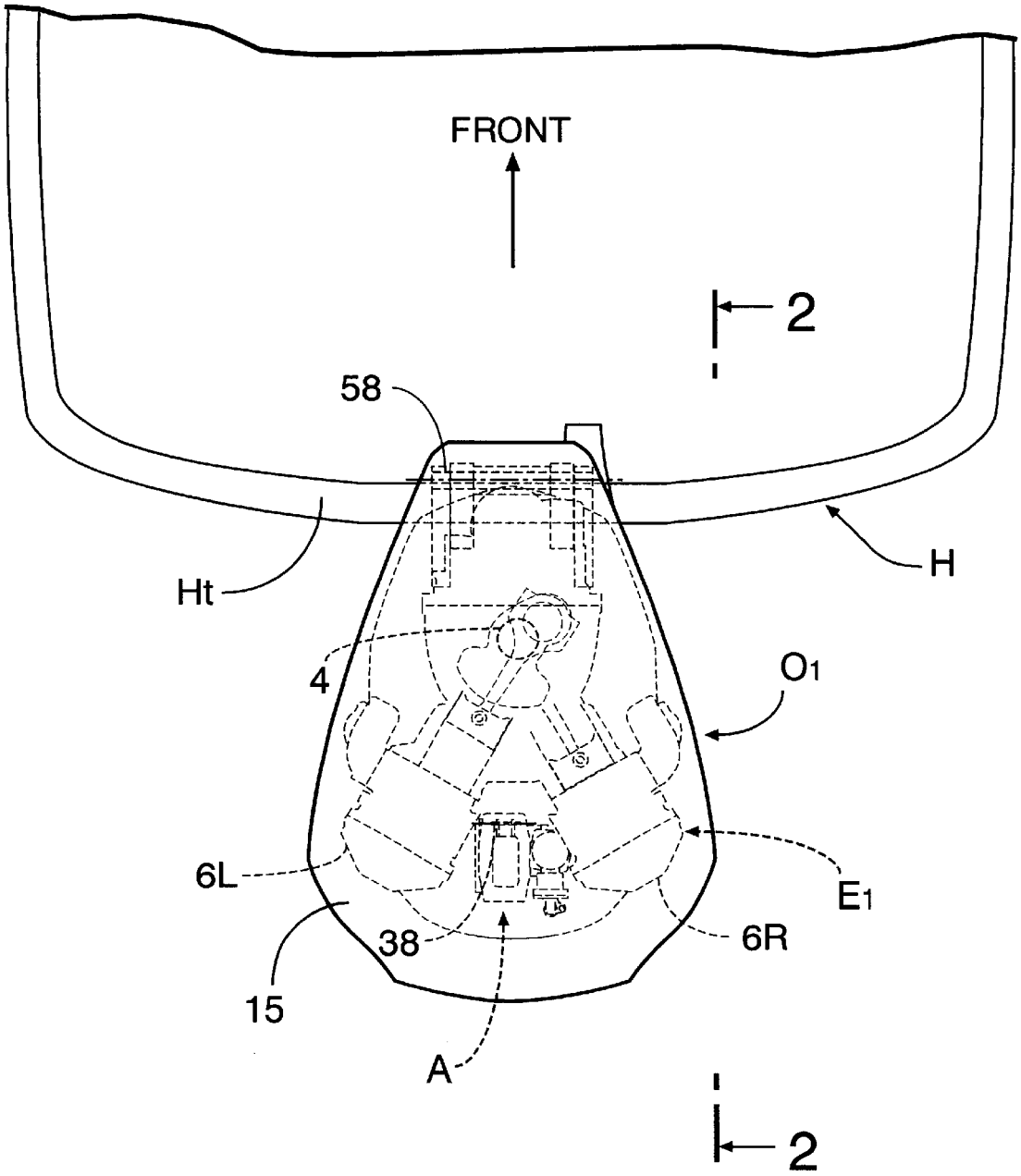
FIG. 1 is a schematic diagram of a plan view of an outboard motor illustrating an auxiliary fuel tank/fuel pump assembly according to the preferred embodiment of the present invention.
Figure 2:
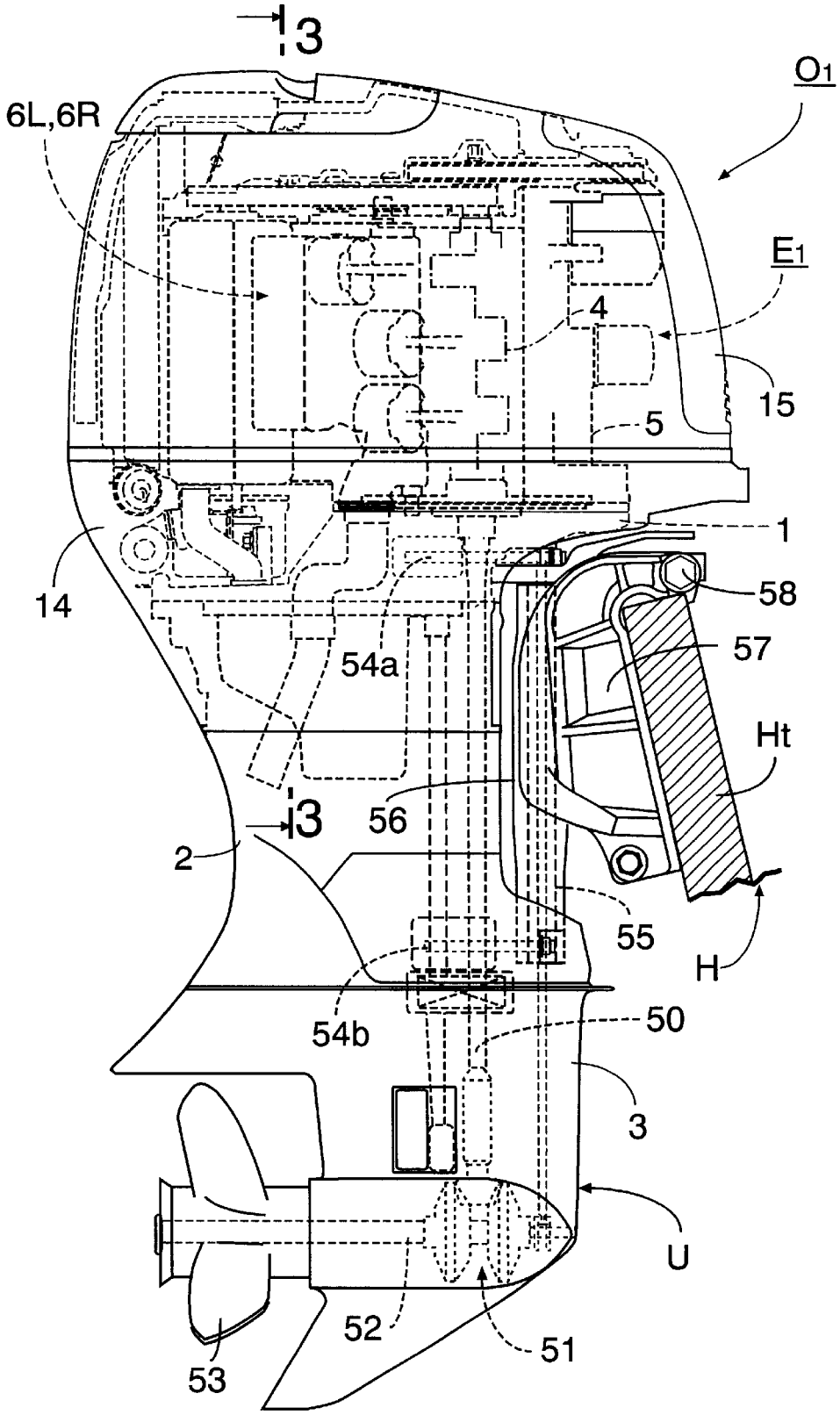
FIG. 2 is a cross-sectional side view taken along line 2—2 of FIG. 1.
Figure 3:
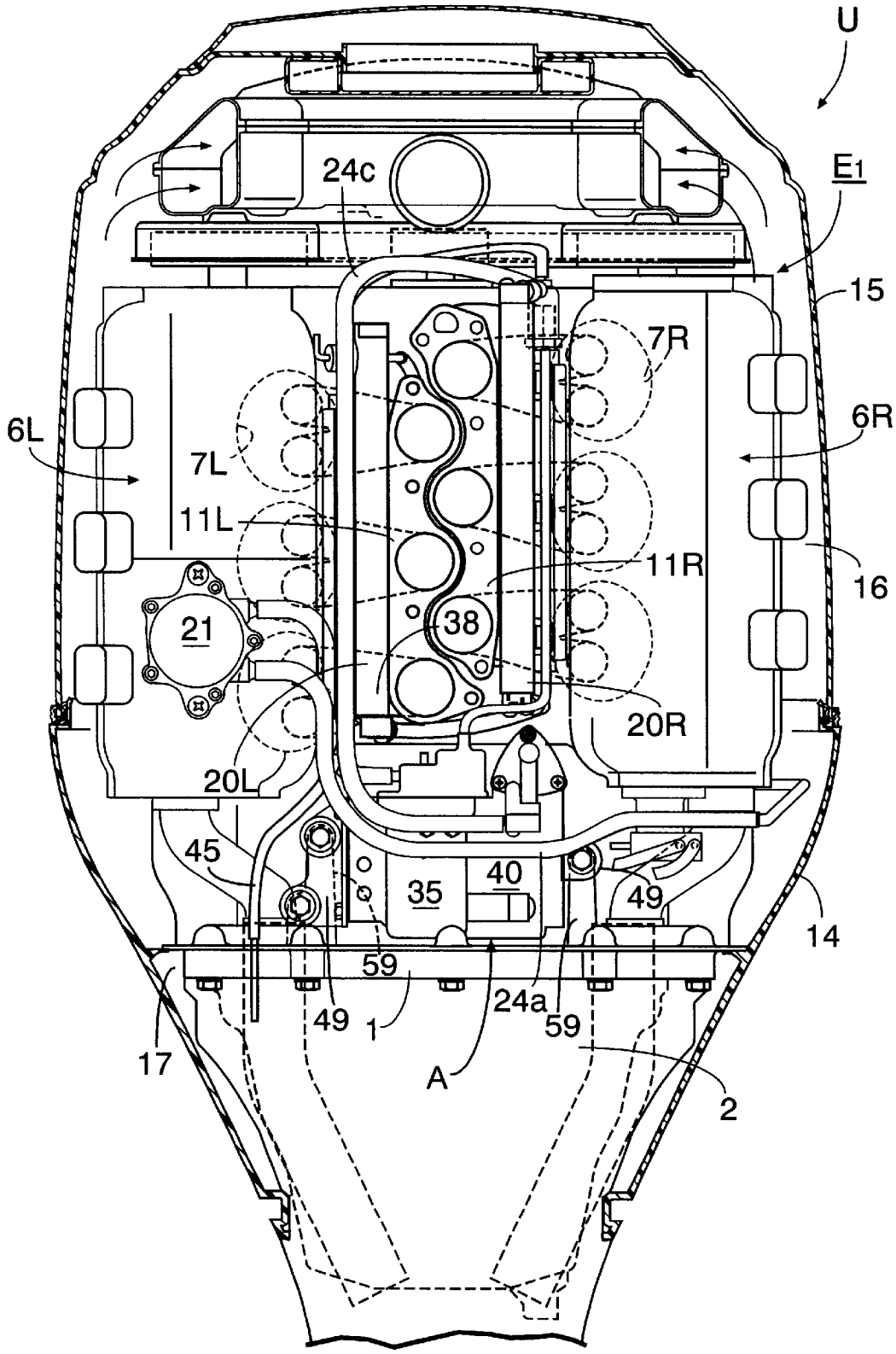
FIG. 3 is a cross-sectional view taken along line 3—3 of FIG. 2.

A preferred embodiment of an auxiliary fuel tank/fuel pump assembly A according to the present invention is explained as follows. As shown in FIGS. 1 to 3, a propulsion unit U of the outboard motor $O_1$ in which the auxiliary fuel tank/fuel pump assembly A is provided, includes a mount case 1, an extension case 2 attached to the lower end face of the mount case 1, and a gear case 3 attached to the lower end face of the extension case 2. A V6 water-cooled four-stroke engine $E_1$ is mounted on the upper end face of the mount case 1 so that its crankshaft 4 is vertical.

An annular undercover 14 is fixed to the mount case 1. The undercover 14 covers a section extending from a lower part of the engine $E_1$ to an upper part of the extension case 2. Detachably fixed to the upper end of the undercover 14 is an engine hood 15 that covers the top of the engine $E_1$. The engine hood 15 and undercover 14 define an engine compartment 16 housing the engine $E_1$.

A drive shaft 50 connected to the crankshaft 4 of the engine $E_1$ extends downward within the extension case 2. The drive shaft 50 is connected at a lower end, via a forward/reverse mechanism 51 provided within the gear case 3, to a propeller shaft 52 having a propeller 53 at the rear end thereof, thereby forming the propulsion unit U.

A swivel shaft 55 is fixed between a pair of left and right upper arms 54*a* connected to the mount case 1 and a pair of left and right lower arms 54*b* connected to the extension case 2. A swivel case 56 rotatably supporting the swivel shaft 55 is supported in a vertically swingable manner, via a tilt shaft 58 that is horizontal in the left-and-right direction, by a stern bracket 57 attached to a transom Ht of the hull H. It is therefore possible to prevent the propeller 53 from grounding when traveling in shallow water by tilting the propulsion unit U upward around the tilt shaft 58 through an appropriate angle.

The engine $E_1$ includes a crankcase 5 supporting the crankshaft 4 and a pair of left and right banks 6L and 6R extending from the crankcase 5 in a V-shape toward the rear. The lower face of the crankcase 5 is joined by a bolt to the upper face of the mount case 1. Each of the banks 6L and 6R includes a plurality of cylinder bores 7L or 7R that are aligned vertically. It should be noted that while FIG. 3 illustrates three cylinder bores, the number shown is merely exemplary, and it is within the scope of the invention to include as many cylinder bores in each bank as required by the particular engine design.

Figure 4:
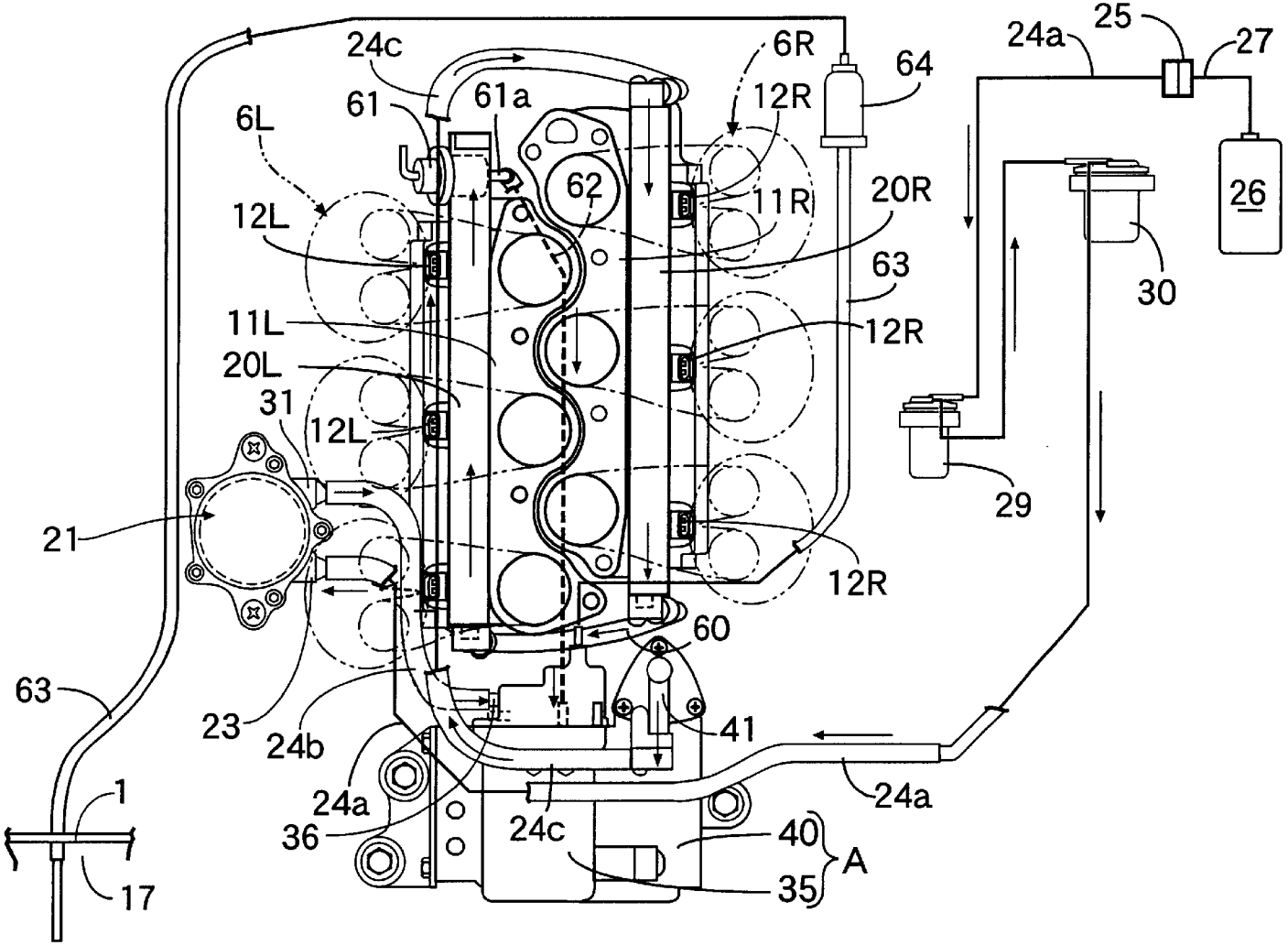
FIG. 4 is a schematic diagram of an engine fuel supply system in the outboard motor.
Figure 5:
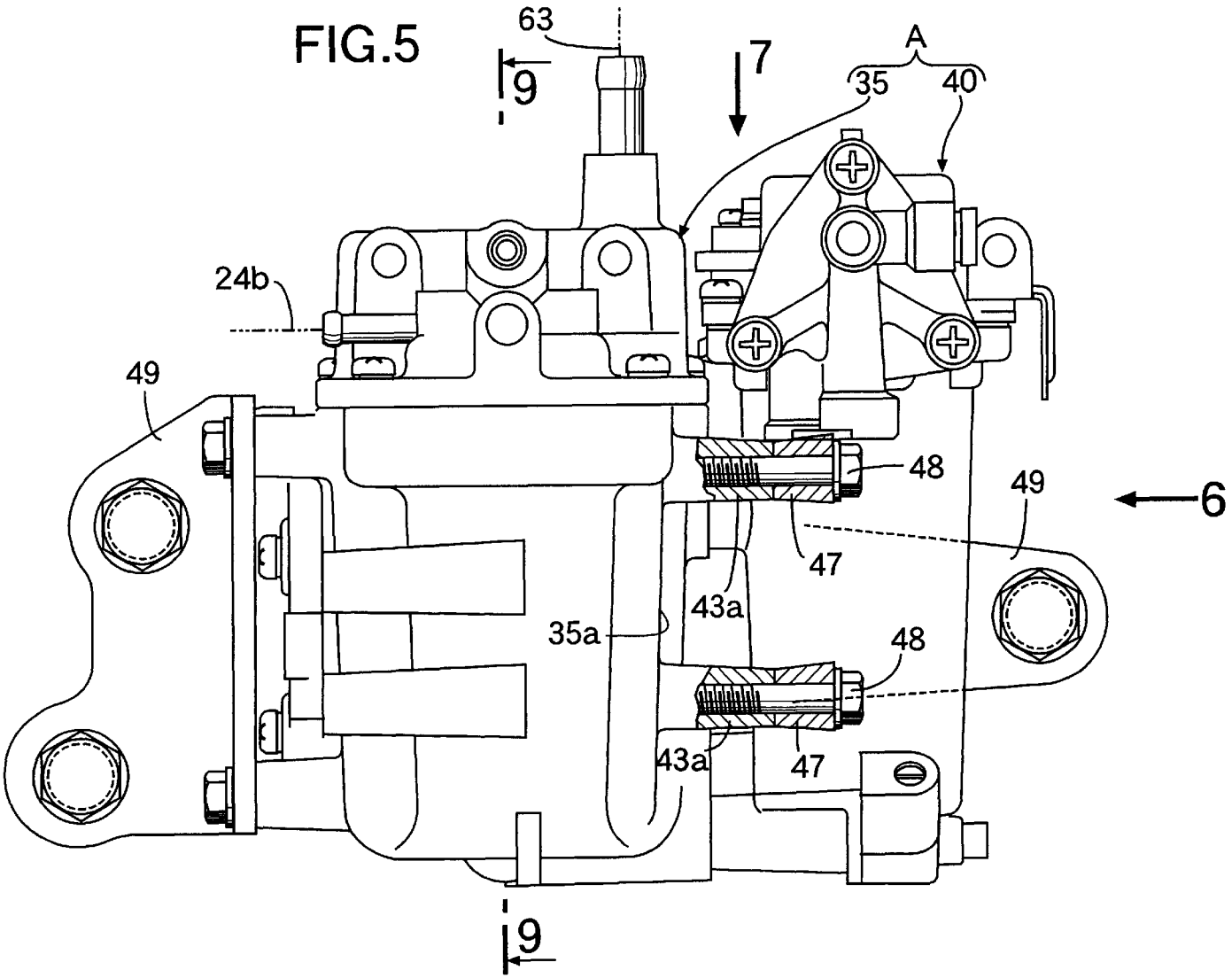
FIG. 5 is an enlarged view of the auxiliary fuel tank/fuel pump assembly of FIG. 3.
Figure 6:
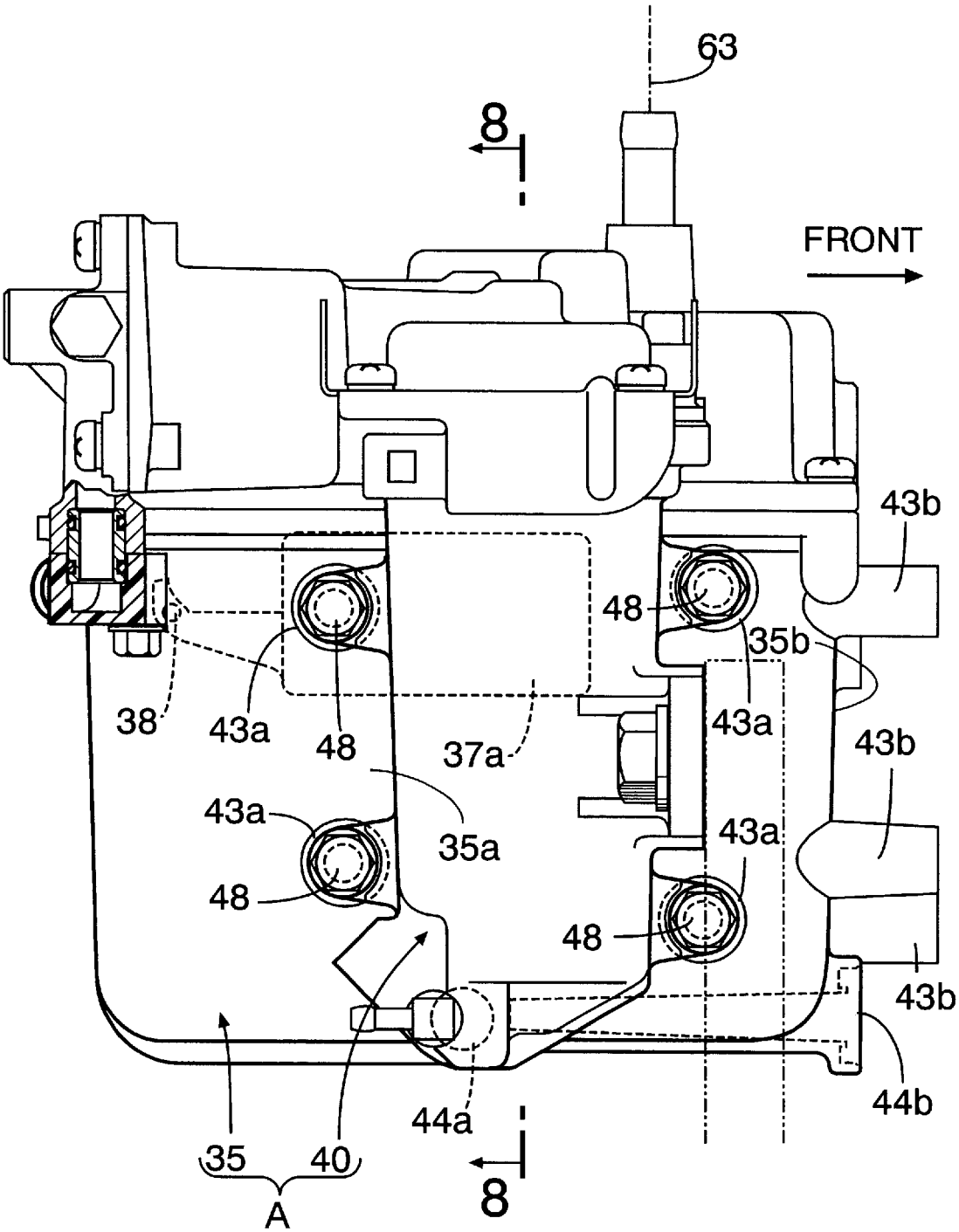
FIG. 6 is a view from arrow 6 of FIG. 5.
Figure 7:
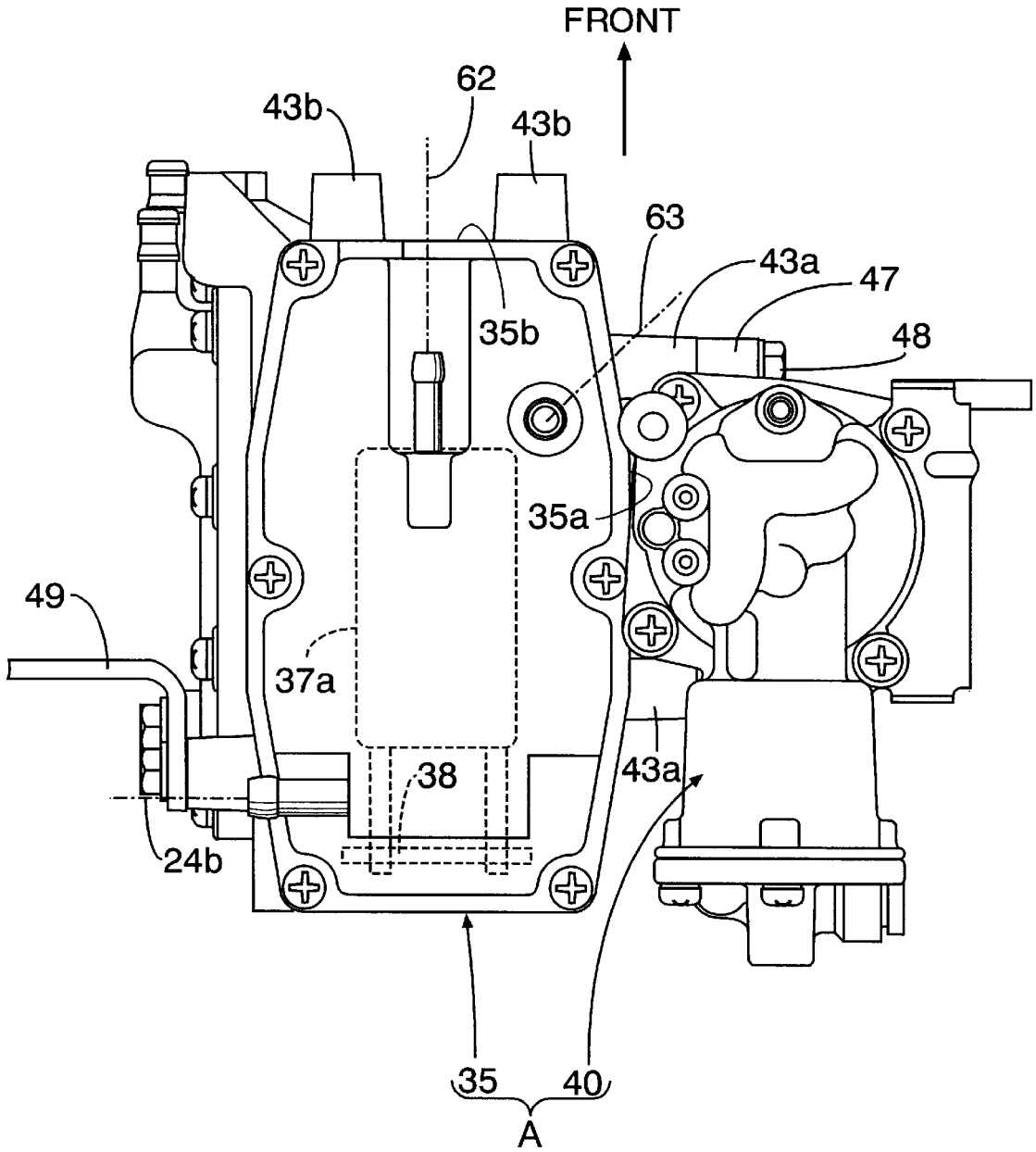
FIG. 7 is a view from arrow 7 of FIG. 5.
Figure 8:
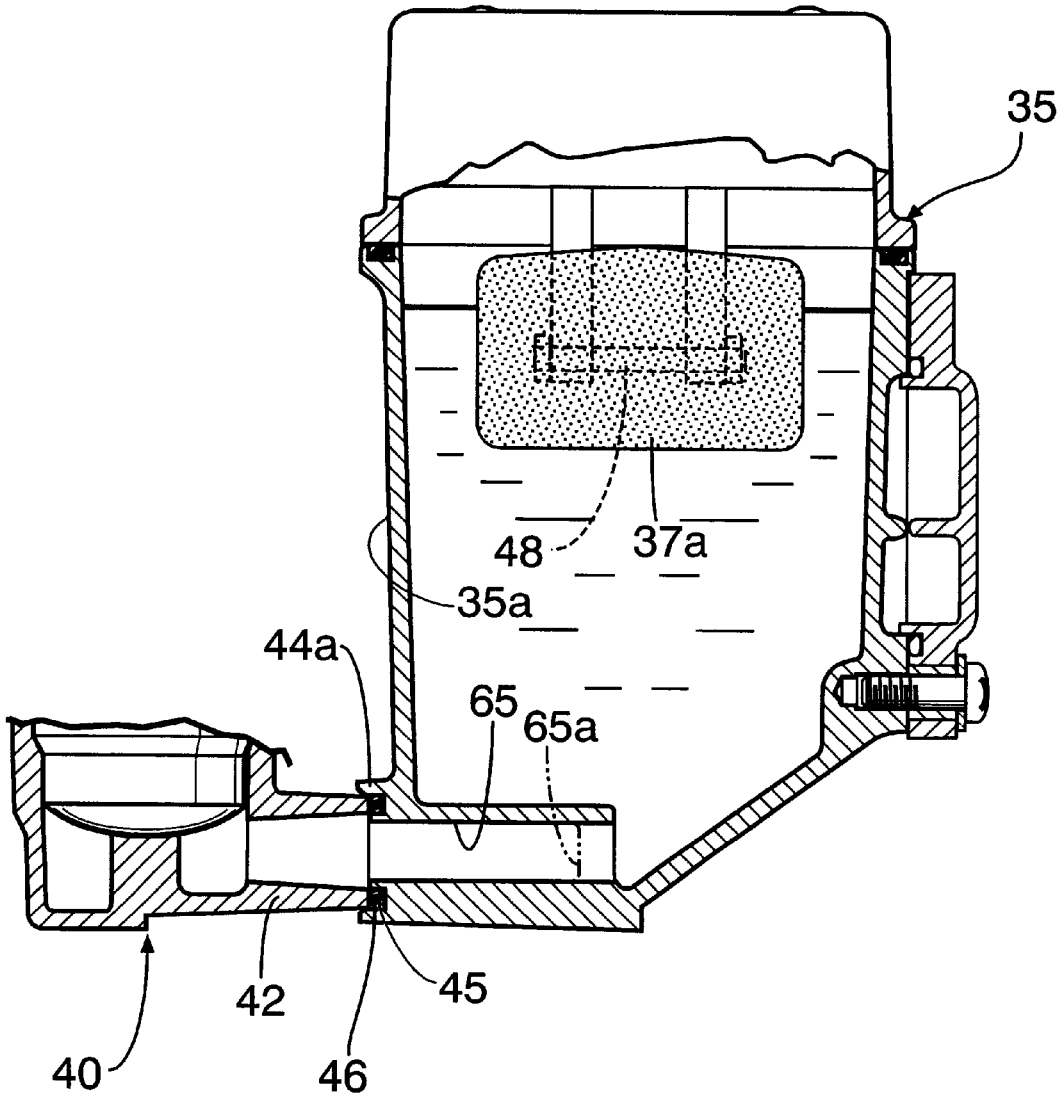
FIG. 8 is a partial cross-sectional view taken along line 8—8 of FIG. 6.
Figure 9:
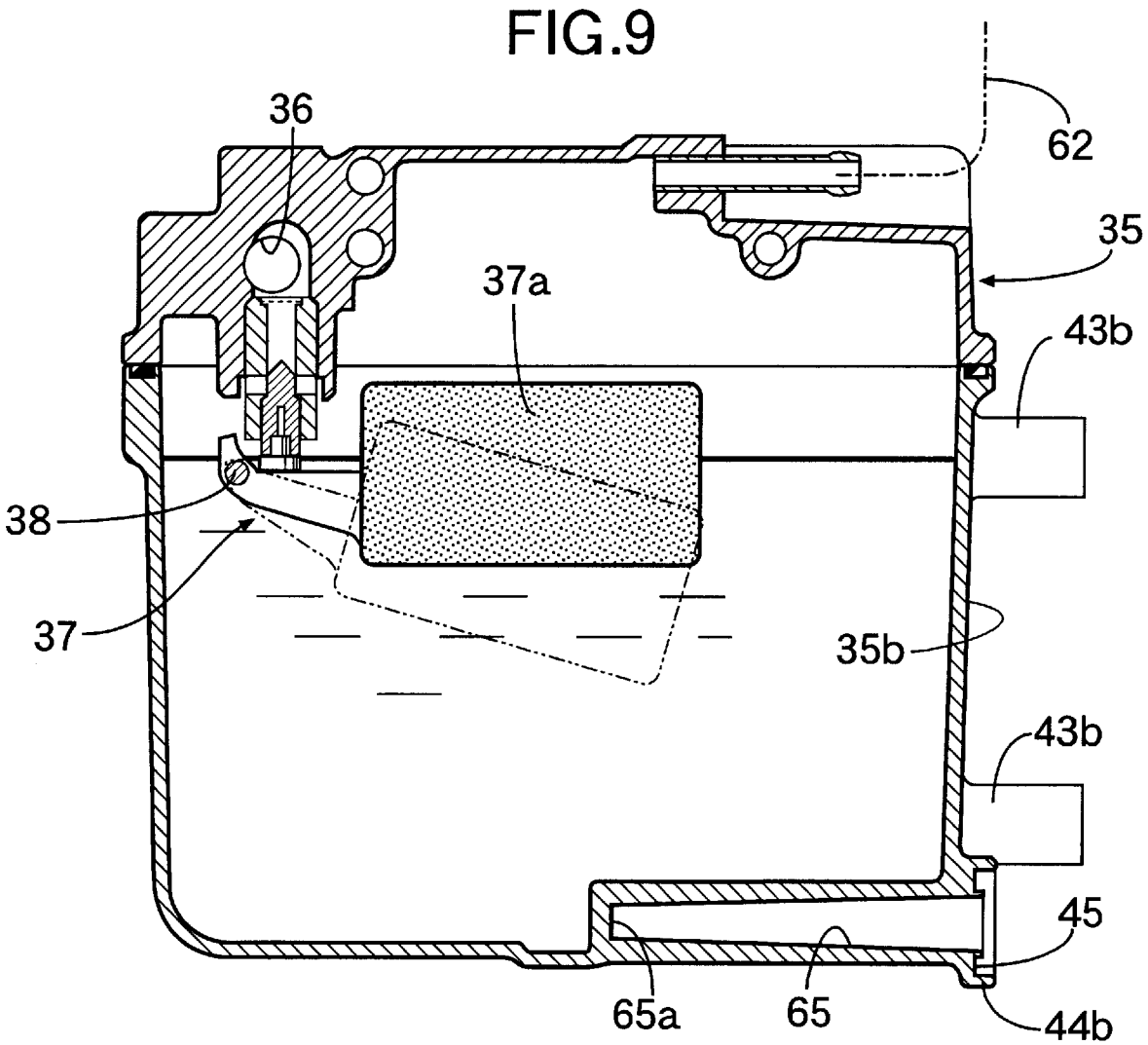
FIG. 9 is a partial cross-sectional view taken along line 9—9 of FIG. 5.
Figure 10:
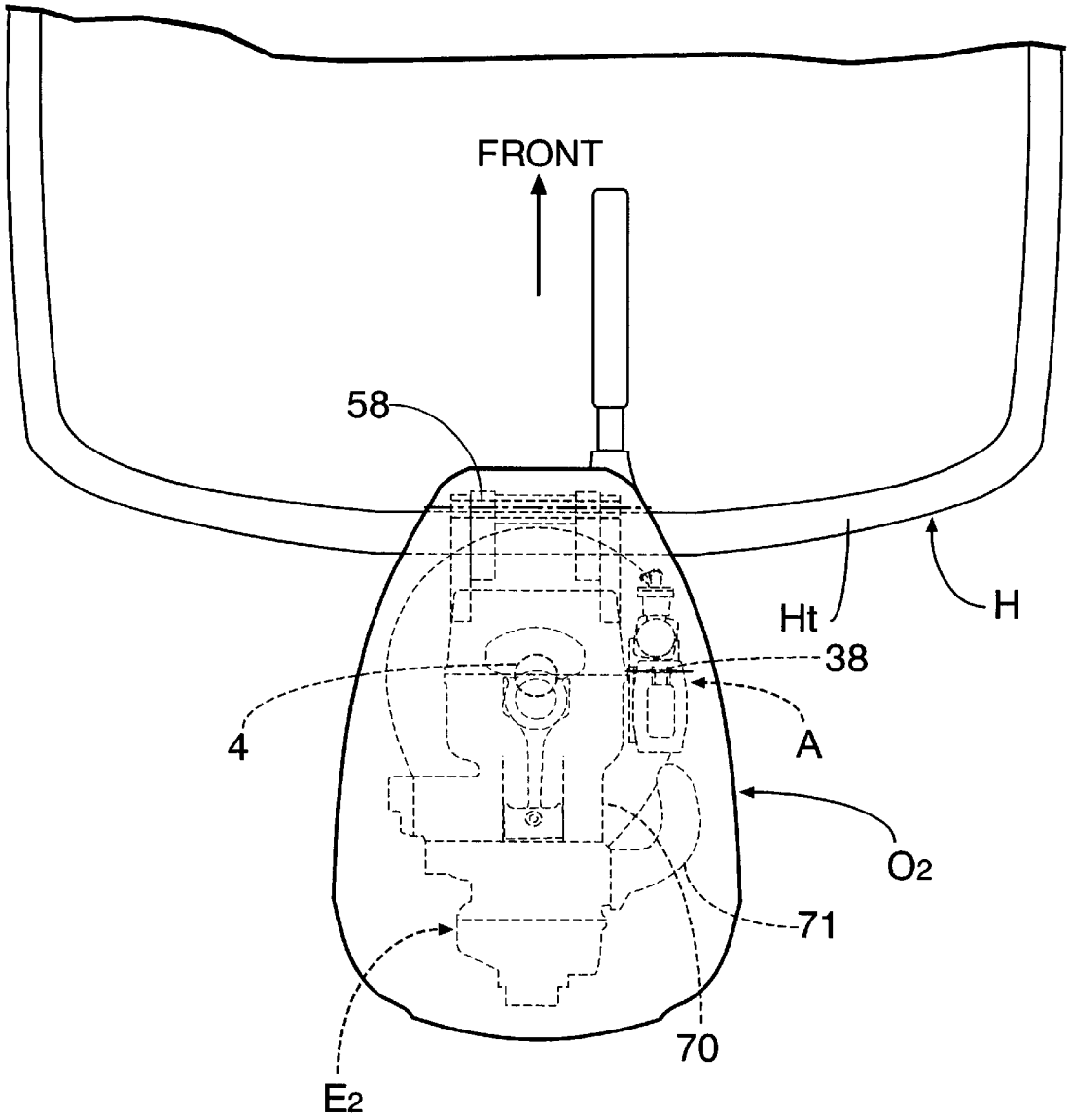
FIG. 10 is a schematic diagram of a plan view of an outboard motor illustrating the auxiliary fuel tank/fuel pump assembly according to a second embodiment of the present invention.
Figure 11:
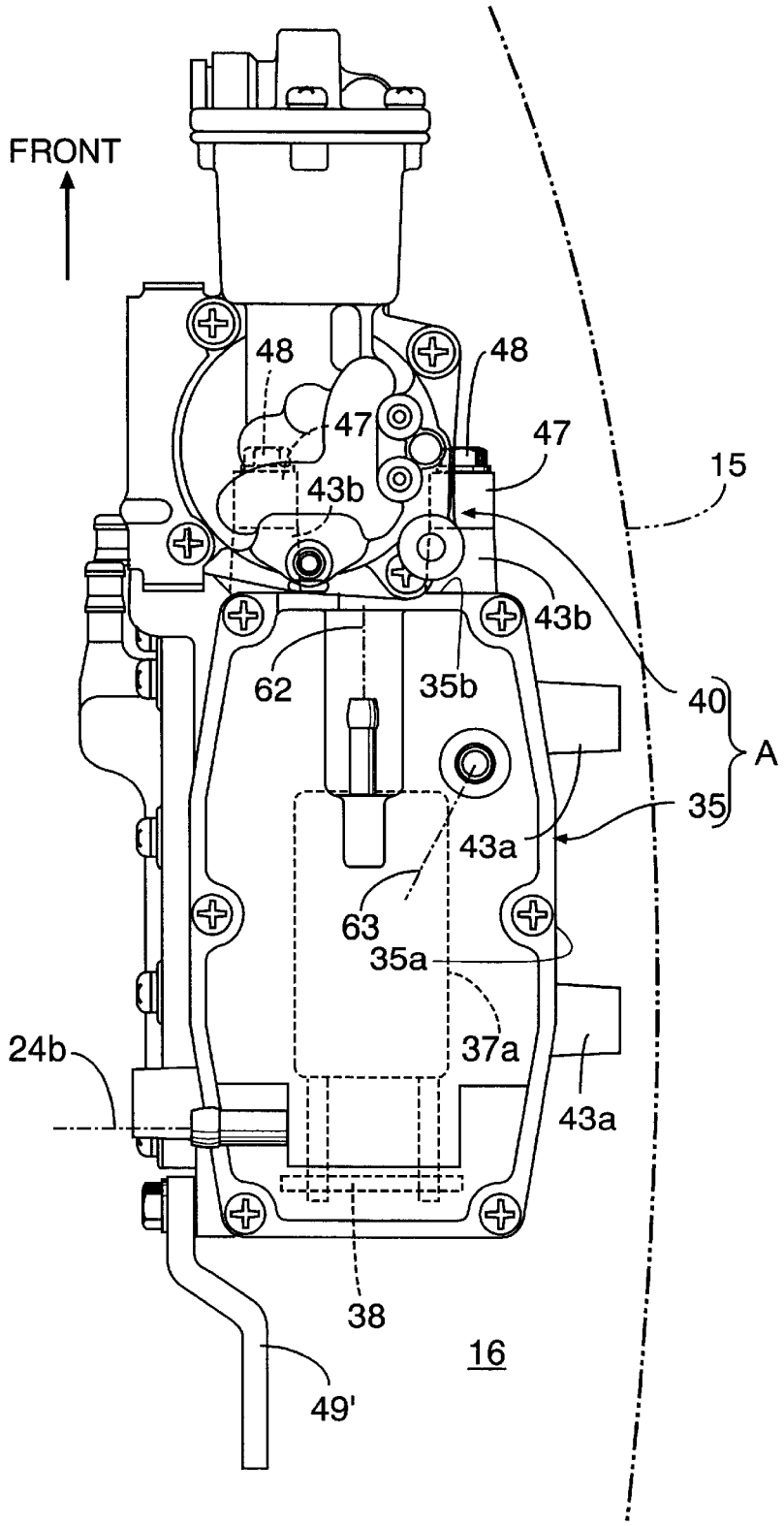
FIG. 11 is an enlarged view of the auxiliary fuel tank/fuel pump assembly of FIG. 10.
Figure 12:
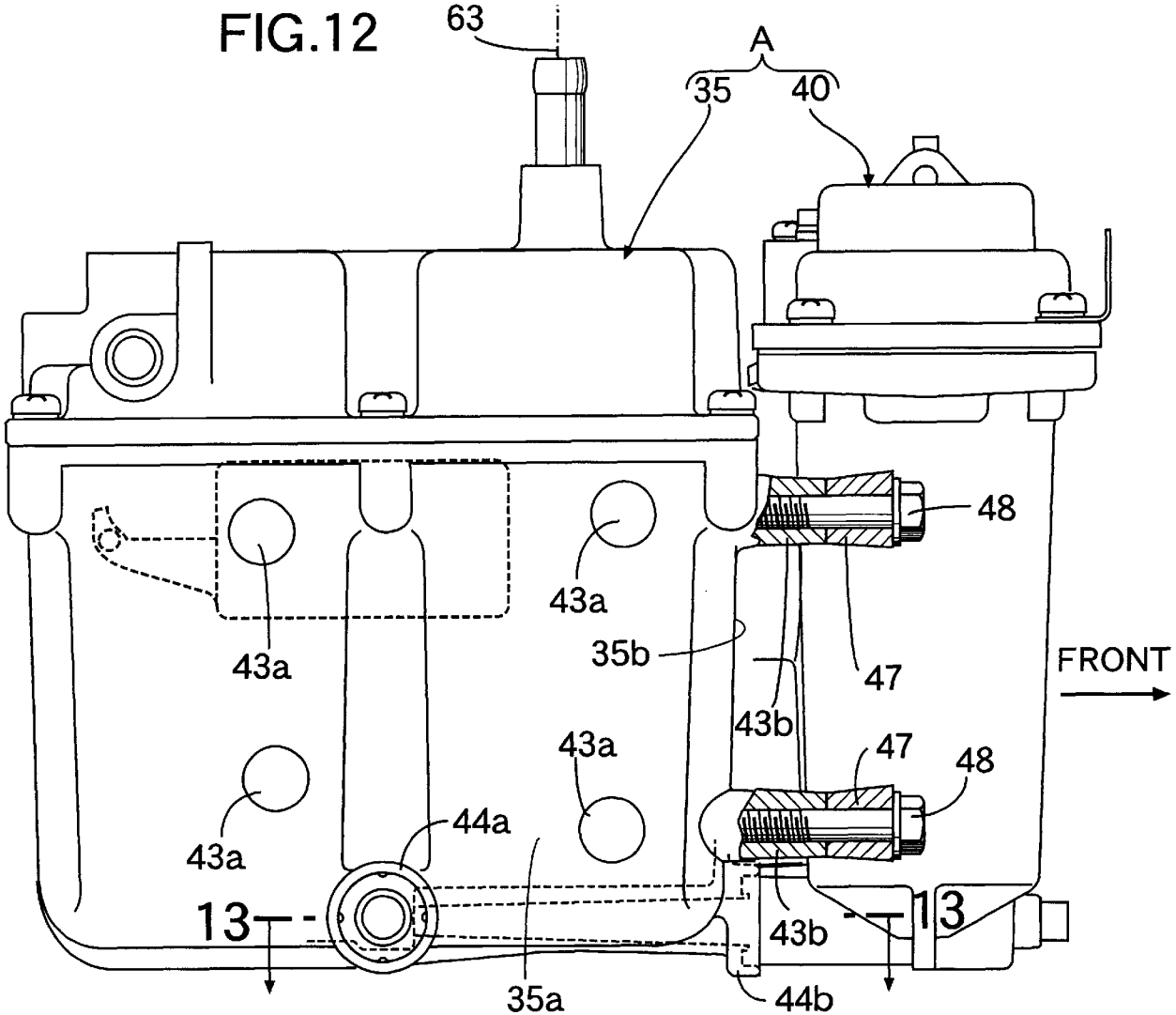
FIG. 12 is a side view of FIG. 11.
Figure 13:
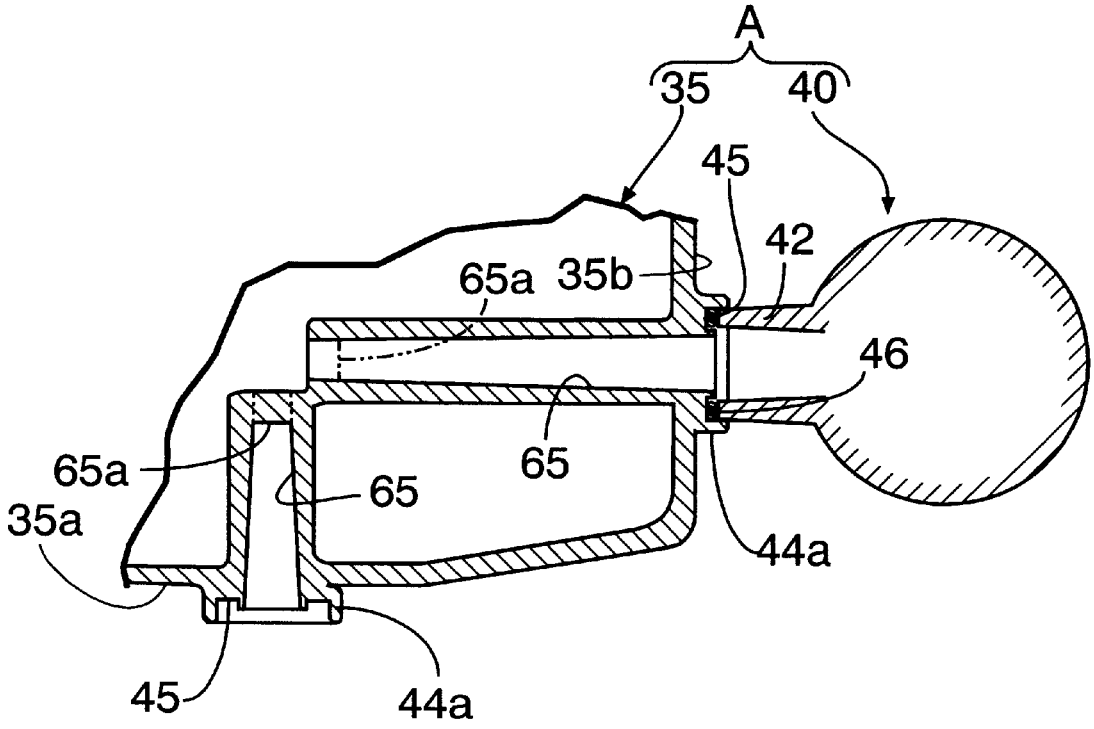
FIG. 13 is a partial cross-sectional view taken along line 13—13 of FIG. 12.

As is clear from FIGS. 3 and 4, attached to intake pipes 11L and 11R of the left and right banks 6L and 6R are electromagnetic fuel injection valves 12L and 12R that inject fuel toward the downstream side of the intake pipes. Left and right fuel rails 20L and 20R are provided for distributing fuel between the fuel injection valves 12L and 12R.

Installed on a head part of one of the banks 6L and 6R is a primary fuel pump 21, for example only, a diaphragm-type pump, mechanically driven by a valve-operating cam shaft installed within the head part. A first fuel pipe 24*a* connected to a suction port 23 of the primary fuel pump 21 is connected, via a joint 25, to a fuel bearing pipe 27 extending from a fuel tank 26 installed on the hull H side.

Disposed partway along the first fuel pipe 24*a* are a first fuel filter 29 and a second fuel filter 30, in that order, from the upstream side. The first fuel filter 29 removes moisture from the fuel, and the second fuel filter 30 removes other foreign substances from the fuel.

An auxiliary fuel tank 35 is disposed on top of the mount case 1 in a space to the rear of the engine $E_1$ within the engine compartment 16. Provided on the top wall of the auxiliary fuel tank 35 is a fuel inlet port 36 to which a discharge port 31 of the primary fuel pump 21 is connected via a second fuel pipe 24*b*. Provided within the auxiliary fuel tank 35 is a known float valve 37 which closes the fuel inlet port 36 when the level of the stored fuel becomes equal to or greater than a predetermined level. As a result, during operation of the engine $E_1$, the auxiliary fuel tank 35 stores a constant amount of fuel that is pumped from the fuel tank 26 by the primary fuel pump 21.

Connected to one side of the auxiliary fuel tank 35 is a motor-operated secondary fuel pump 40 for pumping out the fuel stored therein. The auxiliary fuel tank 35 and secondary fuel pump 40, together, form the auxiliary fuel tank/fuel pump assembly A. A discharge port 41 of the secondary fuel pump 40 is connected to the upper end of the right fuel rail 20R via a third fuel pipe 24*c*. High pressure fuel discharged from the secondary fuel pump 40 fills the right fuel rail 20R from its upper end and then the left fuel rail 20L from its lower end via a communicating pipe 60, and is supplied to each of the fuel injection valves 12L and 12R.

Attached to the upper end of the left fuel rail 20L is a fuel pressure adjuster 61 for adjusting the pressures within the two fuel rails 20L and 20R, that is, the fuel injection pressure of each of the fuel injection valves 12L and 12R. Connected to a surplus fuel outlet pipe 61*a* of the fuel pressure adjuster 61 is a fuel return pipe 62 whose far end opens into the auxiliary fuel tank 35. Consequently, the fuel that has been determined to be surplus by the fuel pressure adjuster 61 is returned to the auxiliary fuel tank 35 via the fuel return pipe 62. The fuel pressure adjuster 61 controls the fuel injection pressure according to the boost pressure, that is, the load of the engine $E_1$.

Connected to the top wall of the auxiliary fuel tank 35 is an air vent pipe 63 that communicates with the space above the fuel surface within the auxiliary fuel tank 35. The air vent pipe 63 first extends upward, bends in an inverted U shape above the engine $E_1$, and then opens into a space 17 within the undercover 14 beneath the mount case 1. A fuel vapor capturing device 64, such as, for example only, a filter, is disposed in the upward path of the air vent pipe 63. The interior of the auxiliary fuel tank 35 breathes via the air vent pipe 63. The fuel vapor generated within the auxiliary fuel tank 35 is captured by the fuel vapor capturing device 64. The liquefied fuel then returns to the auxiliary fuel tank 35.

The auxiliary fuel tank/fuel pump assembly A is explained further in detail by reference to FIGS. 6 to 9.

A float 37*a* of the float valve 37 provided within the auxiliary fuel tank 35 is supported in a vertically swingable manner via a pivot shaft 38 that is parallel to the tilt shaft 58 and extends horizontally in the left-and-right direction. The auxiliary fuel tank 35 has a substantially rectangular shape and is positioned so that its left and right outer sides are perpendicular to the pivot shaft 38 and its front and rear outer end faces are vertical and substantially parallel to the pivot shaft 38. Projectingly and integrally provided on at least one of the left and right outer sides of the auxiliary fuel tank 35 (the right outer side 35*a* in the illustrated example) are a plurality of first mounting bosses 43*a*. Projectingly and integrally provided on at least one of the front and rear outer end faces of the auxiliary fuel tank 35 (the front outer end face 35*b* in the illustrated example) are the same number of second mounting bosses 43*b* in the same arrangement as that of the first mounting bosses 43*a*.

On the other hand, provided on the secondary fuel pump 40 are a plurality of connecting arms 47 that can be fixedly connected securely to either of the first or second mounting bosses 43*a* or 43*b*.

Formed on lower parts of the outer faces of the auxiliary fuel tank 35 on which the first mounting bosses 43*a* and the second mounting bosses 43*b* have been formed, are first and second connecting bosses 44*a* and 44*b* to which the same suction pipe 42 of the secondary fuel pump 40 can be connected. Formed in each of the connecting bosses 44*a* and 44*b* is a fuel outlet port 65 opening on the outer end face of the connecting boss. The inner end of the fuel outlet port 65 is blocked by a blocking wall 65*a* that is integral with the auxiliary fuel tank 35 such that a hole is formed through the blocking wall 65*a* when the corresponding boss 44*a* or 44*b* is connected to the suction pipe 42. An annular seal groove 45 is formed on the outer end of each of the connecting bosses 44*a* and 44*b*. Inserting a seal 46 in the seal groove 45 of the selected connecting boss 44*a* or 44*b* and making the outer end of the suction pipe 42 come into close contact with the seal 46 completes a connection between the selected connecting boss 44*a* or 44*b* and the suction pipe 42, and enables fuel to flow from the auxiliary fuel tank 35 to the secondary fuel pump 40.

When arranging the auxiliary fuel tank/fuel pump assembly A in the space to the rear of the engine $E_1$ in the engine compartment 16, a hole is first machined through the blocking wall 65*a* of the first connecting boss 44*a* so as to provide a connection to the fuel outlet port 65. The seal 46 is inserted in the seal groove 45 at the outer end of the first connecting boss 44*a*. Subsequently, while making the suction pipe 42 of the secondary fuel pump 40 come into close contact with the seal 46, the plurality of connecting arms 47 of the secondary fuel pump 40 are secured to the first mounting bosses 43*a* of the auxiliary fuel tank 35 by bolts 48. The second connecting boss 44*b* and the second mounting bosses 43*b* remain unused. Accordingly, the auxiliary fuel tank 35 and the secondary fuel pump 40 are connected so as to be aligned in the left-and-right direction to form the auxiliary fuel tank/fuel pump assembly A.

While maintaining the pivot shaft 38 of the float valve 37 parallel to the tilt shaft 58, the auxiliary fuel tank 35 is connected to stays 59 (see FIG. 3) rising from the upper face of the mount case 1 via appropriate support brackets 49.

Accordingly, the auxiliary fuel tank/fuel pump assembly A in which the auxiliary fuel tank 35 and the secondary fuel pump 40 are connected so as to be aligned in the left-and-right direction, can be arranged in a reasonable manner in the space to the rear of the engine $E_1$ in the engine compartment 16, the space being particularly narrow in the front-and-rear direction, thereby enhancing the space efficiency and preventing any increase in the dimensions of the engine compartment 16 while avoiding interference between the assembly A and its neighboring members such as the engine hood 15, an engine part, or a pipeline.

Moreover, since the pivot shaft 38 of the float valve 37 within the auxiliary fuel tank 35 is maintained parallel to the tilt shaft 58, the level of the stored fuel is always controlled at a constant level within the auxiliary fuel tank 35 by proper operation of the float valve 37, even when the outboard motor $O_1$ is tilted up.

Turning to FIGS. 10 to 13, a second embodiment of the auxiliary fuel tank/fuel pump assembly A of the present invention is explained. An outboard motor $O_2$ to which the second embodiment of the auxiliary fuel tank/fuel pump assembly A is applied includes an in-line multicylinder engine $E_2$ housed in an engine compartment 16 so that a cylinder head side faces rearward and a crankshaft 4 is vertical. The auxiliary fuel tank/fuel pump assembly A is arranged in a space on the left or right side of the engine $E_2$ in the engine compartment 16.

Thus, when forming the auxiliary fuel tank/fuel pump assembly A, a hole is first machined through in the blocking wall 65*a* of the fuel outlet port 65 in the second connecting boss 44*b* on the front outer end face 35*b* of the auxiliary fuel tank 35 so as to provide a connection to the fuel outlet port 65. The seal 46 is then inserted in the seal groove 45 at the outer end of the second connecting boss 44*b*. Subsequently, while the suction pipe 42 of the secondary fuel pump 40 comes into close contact with the seal 46, the plurality of connecting arms 47 of the secondary fuel pump 40 are secured to the second mounting bosses 43*b* on the front outer end face 35*b* of the auxiliary fuel tank 35 by bolts 48. The first connecting boss 44*a* and the first mounting bosses 43*a* remain unused. Accordingly, the auxiliary fuel tank 35 and the secondary fuel pump 40 are connected so as to be aligned in the front-and-rear direction to form the auxiliary fuel tank/fuel pump assembly A.

Thus, while maintaining the pivot shaft 38 of the float valve 37 parallel to the tilt shaft 58, the auxiliary fuel tank 35 is mounted on one outer side of the engine $E_2$ via appropriate support brackets 49'. For example, it is fixed to an intake manifold 71 placed along one side of a cylinder block 70.

Accordingly, the auxiliary fuel tank/fuel pump assembly A in which the auxiliary fuel tank 35 and the secondary fuel pump 40 are joined in the front-and-rear direction can be arranged in a reasonable manner in the space to the side of the engine $E_2$ in the engine compartment 16, the space being particularly narrow in the left-and-right direction, thereby enhancing the space efficiency and avoiding interference between the assembly A and its neighboring members. Moreover, the pivot shaft 38 of the float valve 37 within the auxiliary fuel tank 35 can be maintained parallel to the tilt shaft 58.

Furthermore, since the auxiliary fuel tank/fuel pump assembly A in the first and second embodiments can use the identical auxiliary fuel tank 35 and the identical fuel pump 40, the mass-productivity of the auxiliary fuel tank 35 is improved and the overall cost of the assembly A can be reduced.

In FIGS. 10 to 13, apart from the reference numerals and symbols $O_2$ and $E_2$ for the outboard motor and the engine, parts corresponding to those in the preceding application example are denoted by the same reference numerals and symbols, and their explanation is omitted to avoid redundancy.

Although preferred embodiments of the present invention have been described in detail above, it should be noted that the present invention can be modified in a variety of ways without departing from the spirit and scope of the invention. For example, the auxiliary fuel tank 35 may have one connecting pipe having a permanently open fuel outlet port 65, and the connecting pipe can be connected to the suction pipe 42 of the secondary fuel pump 40 via a flexible fuel pipe.

We claim:

1. An outboard motor auxiliary fuel tank/fuel pump assembly comprising:

an auxiliary fuel tank that is disposed in an engine compartment of an outboard motor and stores fuel fed from a fuel tank on a hull;

a fuel pump that is joined to one side of the auxiliary fuel tank and supplies the fuel stored within the auxiliary fuel tank to a fuel injection valve of an engine;

a float valve having a float and provided within the auxiliary fuel tank, for opening and closing a fuel inlet port of the auxiliary fuel tank according to a level of the stored fuel, the float being supported in a vertically swingable manner within the auxiliary fuel tank via a pivot shaft that is parallel to a tilt shaft of the outboard motor;

an air vent pipe that is connected to the auxiliary fuel tank and communicates with an upper space within the auxiliary fuel tank; and first and second mounting parts on which the fuel pump can be mounted, the mounting parts being formed, respectively, on an outer face of the auxiliary fuel tank that is vertical and perpendicular relative to the tilt shaft and on an outer face of the auxiliary fuel tank that is vertical and parallel relative to the tilt shaft.

2. The assembly according to claim 1 further comprising:

first and second connecting bosses provided, respectively, on the outer face of the auxiliary fuel tank on which the first mounting part has been formed and on the outer face of the auxiliary fuel tank on which the second mounting part has been formed; and a suction pipe of the fuel pump that is connectable to the first and second connecting bosses, wherein the connecting bosses comprise a blocking wall through which a hole is formed when the suction pipe is connected thereto.

* * * * *

UNITED STATES PATENT AND TRADEMARK OFFICE

CERTIFICATE OF CORRECTION

PATENT NO. : 6,616,490 B2
DATED : September 9, 2003
INVENTOR(S) : Wada et al.

It is certified that error appears in the above-identified patent and that said Letters Patent is hereby corrected as shown below:

Title page,
Item [73], please correct the spelling of the second Assignee from "Keiflin" to
-- Keihin --

Signed and Sealed this

Ninth Day of March, 2004

JON W. DUDAS
*Acting Director of the United States Patent and Trademark Office*